US007777678B2

(12) United States Patent
Hsu et al.

(10) Patent No.: US 7,777,678 B2
(45) Date of Patent: Aug. 17, 2010

(54) ASSEMBLY ANTENNA ARRAY

(75) Inventors: Cheng-Hsuan Hsu, Taipei County (TW); Po-Sheng Chen, Taipei County (TW); Tsung-Wen Chiu, Taipei County (TW); Fu-Ren Hsiao, Taipei County (TW)

(73) Assignee: Advanced Connectek, Inc., Taipei County (TW)

( * ) Notice: Subject to any disclaimer, the term of this patent is extended or adjusted under 35 U.S.C. 154(b) by 72 days.

(21) Appl. No.: 12/212,444

(22) Filed: Sep. 17, 2008

(65) Prior Publication Data

US 2009/0167611 A1 Jul. 2, 2009

(51) Int. Cl.
*H01Q 1/38* (2006.01)

(52) U.S. Cl. ..... 343/700 MS

(58) Field of Classification Search ..... 343/700 MS, 343/846

See application file for complete search history.

(56) References Cited

U.S. PATENT DOCUMENTS 5,923,296 A 7/1999 Sanzgiri et al.
6,735,849 B2 * 5/2004 Cheng et al. ..... 29/600
6,985,123 B2 1/2006 Gottl
2002/0180644 A1 * 12/2002 Carson et al. ..... 343/700 MS
2003/0189516 A1 * 10/2003 Olson ..... 343/700 MS

* cited by examiner

*Primary Examiner*—Tan Ho
(74) *Attorney, Agent, or Firm*—Schmeiser, Olsen & Watts LLP

(57) ABSTRACT

An assembly antenna array comprises a ground plate, a pair of first radiation conductors, a first transmission member, first support rods, a pair of second conductors, a second transmission member, and second support rods. The ground plate has an upper surface and a lower surface. The layout size of the assembly antenna array is reduced via arranging the arrayed first radiation conductors and the arrayed second radiation conductors vertically to each other. The mutual interference between the transmission members is inhibited via respectively arranging the transmission members and the feeding ends of the two pairs of radiation conductors on different surfaces. A feeder cable is connected to an appropriate position of each transmission member to enable each pair of radiation conductors to have a phase difference of 180 degrees, whereby cross-polarization is reduced, and the gain are increased.

18 Claims, 9 Drawing Sheets

| Freq(MHz) | Peak Gain(MHz) | Peak angle | Avg Gain(dBi) |
|---|---|---|---|
| 3500.00 | 9.00 | 188.06 | 2.34 |

| Freq(MHz) | Peak Gain(MHz) | Peak angle | Avg Gain(dBi) |
|---|---|---|---|
| 3500.00 | 9.50 | 169.31 | 3.28 |

ASSEMBLY ANTENNA ARRAY

BACKGROUND OF THE INVENTION

1. Field of the Invention

The present invention relates to an assembly antenna array, particularly to an integration antenna array, wherein several antenna arrays share a common ground plate.

2. Description of the Related Art

An antenna array is an antenna system consisting of a plurality of identical antennae, such as symmetrical antennae, arranged according to a special rule. A single antenna is hard to control its radiation pattern and hard to have sufficient gain. Further, the important parameters of a single antenna are less likely to meet a high-standard application. Therefore, some products needing high transmission quality have to adopt antenna arrays. In an antenna array, the component antenna units are arranged according to a special rule and have a special signal feeding method to attain the required effect. The more the antenna units of an antenna array, the higher the gain, and the larger the size.

In a conventional antenna array, radiation conductors of identical antennae are parallel arranged into an arrayed structure, and the spacing therebetween is 0.5-0.9 wavelength of the wireless signal. When looked top down, the radiation energy of an antenna array exhibits an 8-shape distribution. On two planes respectively parallel and vertical to the antenna radiation conductors, a user receives two signals from the antennae at the same time, wherein the phases of the two signals are identical, and the transmission distances of the two signals are the longest. When the two signals of identical phases are combined, the intensity of the combined signals is double the intensity of a single signal. In other words, the gain increases by 3 dB.

In the conventional design of antenna arrays, there are mainly two methods to form a dipole antenna array having dual polarizations. One method thereof is exemplified by a U.S. Pat. No. 5,923,296 "Dual Polarized Microstrip Patch Antenna Array for PCS Base Stations" shown in FIG. 1, wherein a set of copper patches 3 and a set of copper patches 5 are alternately arranged on a printed circuit board 1 to form two antenna arrays polarized vertically to each other. However, the volume of such a design doubles that of the ordinary antenna array. Besides, the two antenna structures are asymmetric. Thus, the radiation patterns thereof have a great difference, and interference is likely to occur therebetween.

Another method is exemplified by a U.S. Pat. No. 6,985,123 "Dual-Polarization Antenna Array" shown in FIG. 2, wherein a single set of antenna elements 15' cooperates with two sets of mutually-vertical feed-in signals 13' to generate two sets of mutually-vertical antenna array signals in a same radiation conductor structure. However, such a design needs a very complicated network of feed-in transmission cables. Thus, the signal will greatly attenuate, and interference between the transmission cables increases. Besides, the antenna structure is hard to fabricate and thus has a high fabrication cost and a low yield. Further, as two sets of antenna array signals are excited on the surface of the same radiation structure, the interference between antennae is very obvious.

To overcome the conventional problems, the present invention proposes an assembly antenna array, which adopts the arrayed radiation conductors arranged vertically to greatly reduce the size of the antenna structure, and which uses the transmission members arranged on different surfaces of the ground plate to feed signals into the network, whereby the complexity of the antenna structure is greatly reduced, and whereby the ground plate blocks the interference between the transmission members, wherefore the present invention has the minimum loss and the best radiation transmission efficiency.

SUMMARY OF THE INVENTION

One objective of the present invention is to provide an assembly antenna array, wherein the layout size of the antenna module is reduced via arranging arrayed first radiation conductors and arrayed second radiation conductors vertically to each other, whereby the present invention is easy-to-assemble for various electronic devices, and whereby the fabrication becomes easier and the fabrication cost is reduced.

Another objective of the present invention is to provide an assembly antenna array, wherein the transmission members of first radiation conductors and second radiation conductors are arranged on different surfaces of the ground plate to reduce the interference between the transmission members, whereby the complexity of the networks of the transmission members is reduced, and whereby the radiation transmission efficiency is increased.

A further objective of the present invention is to provide an assembly antenna array, wherein a feeder cable is connected to an appropriate position of the transmission member of first radiation conductors or second radiation conductors to enable the first radiation conductors or the second radiation conductors to have a phase difference of 180 degrees, whereby cross-polarization is reduced, and the gain is increased.

To achieve the abovementioned objectives, the present invention proposes an assembly antenna array comprising a ground plate, a pair of first radiation conductors, a first transmission member, first support rods, a pair of second conductors, a second transmission member, and second support rods. The ground plate has an upper surface and a lower surface. A first axis and a second axis are defined on the ground plate and vertical to each other. The first radiation conductors are arranged above the upper surface. The first transmission member bridges the first radiation conductors and is parallel to the first axis. The first support rods are arranged in between the first radiation conductors and the upper surface of the ground plate. The second radiation conductors are also arranged above the upper surface of the ground plate. The second transmission member is arranged on the lower surface of the ground plate and parallel to the second axis. The second support rods are arranged in between the second radiation conductors and the upper surface of the ground plate.

In a first embodiment, the first radiation conductors are a pair of arrayed radiation conductors arranged above the upper surface of the ground plate but separated from the upper surface by a gap. The first transmission member bridges the first radiation conductors. A first feeder cable is connected to an appropriate position of the first transmission member to form a first feeding end. Signals are fed into the first transmission member from the first feeding end and evenly transmitted to the first radiation conductors. The position of the first feeding end is carefully selected to make the two first radiation conductors have a phase difference of 180 degrees. As the two first radiation conductors are symmetrical arrays, the fundamental mode currents excited by the two first radiation conductors have opposite directions. After the phase-difference modulation, the fundamental mode radiation signals of the two first radiation conductors have the same direction. Thus, the gain of the first antenna system formed of the first radiation conductors is multiplied synergistically. For the cross-polarization currents vertical to the fundamental mode, the two radiation conductors excite identical-direction currents. After the phase-difference modulation, the two radiation conductors inhibit the radiation signals mutually. Thus, cross-polarization is reduced, and the antenna gain is increased.

The second radiation conductors are also a pair of arrayed radiation conductors arranged above the upper surface of the ground plate, and the second radiation conductor are also separated from the upper surface by a gap. The second radiation conductors are vertical to the first radiation conductors. The second transmission member is arranged on the lower surface of the ground plate, and two ends of the second transmission member pass through via-holes to connect with the second radiation conductors. A second feeder cable is connected to an appropriate position of the second transmission member to form a second feeding end. Signals are fed from the second feeding end and evenly transmitted to the second radiation conductors. The position of the second feeding end is carefully selected to make the two second radiation conductors have a phase difference of 180 degrees. The second antenna system formed of the second radiation conductors achieves the same effect as the first antenna system formed of the first radiation antenna system, and the gain of the second antenna system is also multiplied synergistically.

A second embodiment of the present invention is basically similar to the first embodiment but different from the first embodiment in that the ground plate has at least two slots penetrating the upper surface and the lower surface. The slots are located on the region where the ground plate faces the second radiation conductors. The second transmission member couples signals to the second radiation conductors via the slots. Thereby, the second embodiment can achieve the same effect as the first embodiment.

Below, the embodiments are described in detail to make easily understood the technical contents of the present invention.

DETAILED DESCRIPTION OF THE INVENTION

Figure 1:
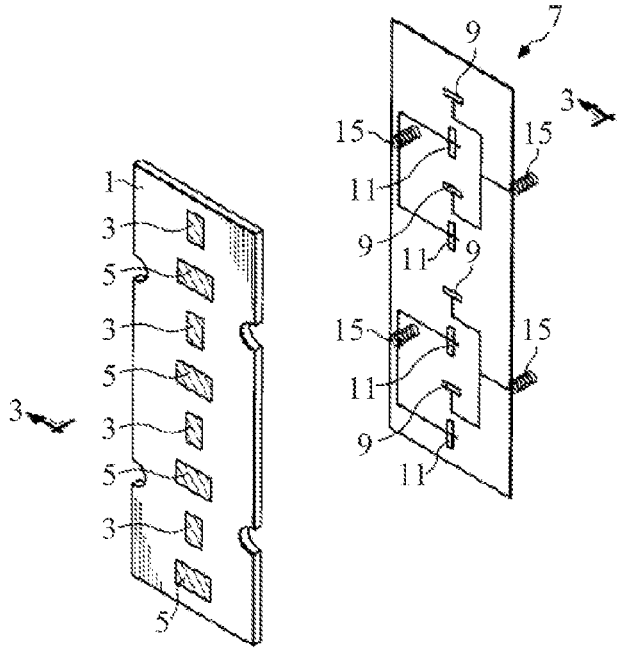
FIG. 1 PRIOR ART
FIG. 1 is a perspective view showing a prior art "Dual Polarized Microstrip Patch Antenna Array for PCS Base Stations;"
Figure 2:
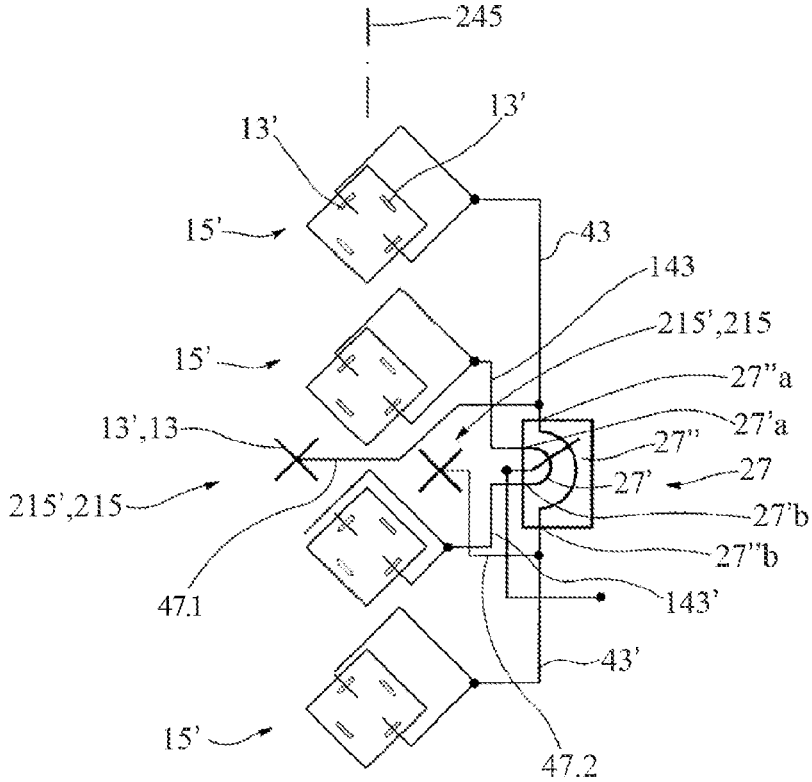
FIG. 2 PRIOR ART
FIG. 2 is a top view showing a prior art "Dual-Polarization Antenna Array;"
Figure 3:
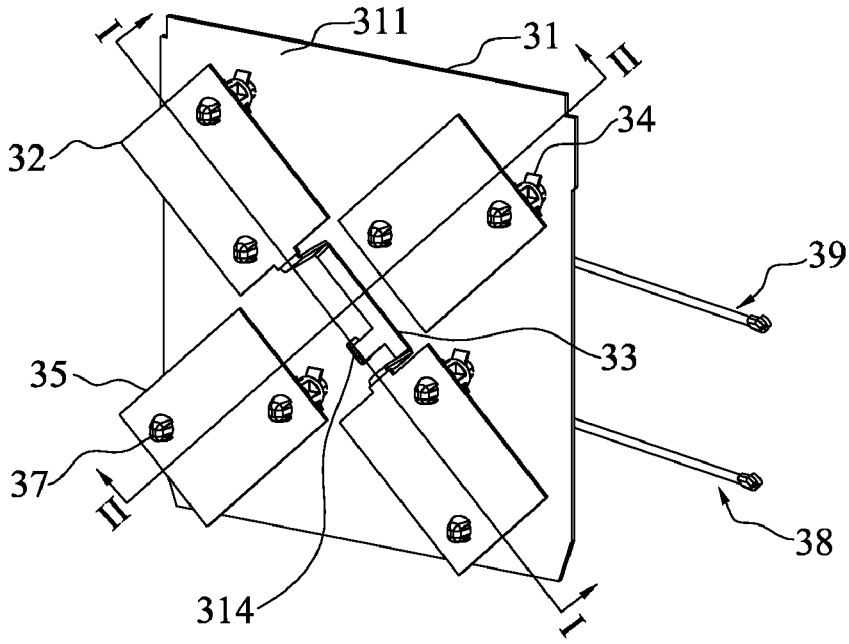
FIG. 3 is a perspective view schematically showing the upper surface an assembly antenna array according to the first embodiment of the present invention.
Figure 4:
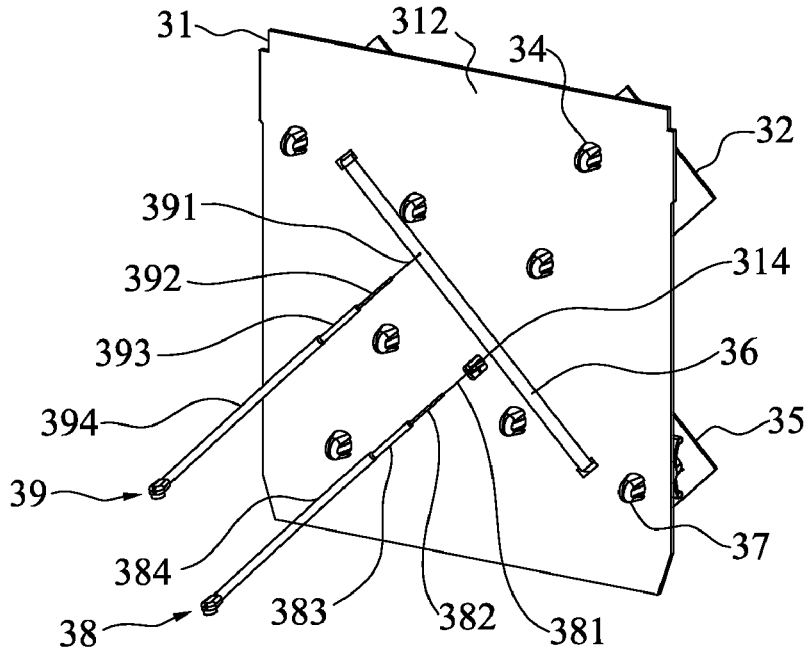
FIG. 4 is a perspective view schematically showing the lower surface of the assembly antenna array according to the first embodiment of the present invention.

FIG. 3 and FIG. 4 are perspective views schematically showing the upper surface and the lower surface of an assembly antenna array according to the first embodiment of the present invention. The antenna array of the present invention comprises a ground plate 31, a pair of first radiation conductors 32, a first transmission member 33, first support rods 34, a pair of second conductors 35, a second transmission member 36, and second support rods 37.

The ground plate 31 has an upper surface 311 and a lower surface 312. A first axis I-I and a second axis II-II are defined on the ground plate 31 and vertical to each other. The first radiation conductors 32 are arranged above the upper surface 311. The first transmission member 33 bridges the first radiation conductors 32 and is parallel to the first axis I-I. The first support rods 34 are arranged in between the first radiation conductors 32 and the upper surface 311 of the ground plate 31. The second radiation conductors 35 are also arranged above the upper surface 311 of the ground plate 31. The second transmission member 36 is arranged on the lower surface 312 of the ground plate 31 and parallel to the second axis II-II. The second transmission member 36 passes through via-holes 314 to connect with the second radiation conductors 35. The second support rods 37 are arranged in between the second radiation conductors 35 and the upper surface 311 of the ground plate 31.

In the first embodiment, the ground plate 31 is made of a PCB (Printed Circuit Board) material. The first radiation conductor 32 is secured to the upper surface 311 of the ground plate 31 with the first support rods 34. The support rods 34 are made of an insulating material and make a gap form between the first radiation conductor 32 and the ground plate 31. The first radiation conductors 32 are a pair of arrayed radiation conductors symmetrical to each other. The first transmission member 33 bridges the first radiation conductors 32 and is parallel to the first axis I-I. Therefore, the first radiation conductors 32 are also parallel to the first axis I-I. A first feeder cable 38 has a central conductor 381, an inner insulation layer 382, an outer conductor 383 and an outer insulation layer 384 in sequence from the center. The central conductor 381 passes through the via-hole 314 to connect with the first transmission member 33 at an appropriate position where a signal feeding end is formed. Signals are fed into the first transmission member from the signal feeding end and evenly transmitted to the first radiation conductors 32. The position of the signal feeding end is carefully selected to make the two first radiation conductors 32 have a phase difference of 180 degrees.

As the two first radiation conductors 32 are symmetrical arrays, the fundamental mode currents excited by the two first radiation conductors 32 have opposite directions. After the phase-difference modulation, the fundamental mode radiation signals of the two first radiation conductors 32 have the same direction. Thus, the gain of the first antenna system formed of the first radiation conductors 32 is multiplied synergistically. For the cross-polarization currents vertical to the fundamental mode, the two radiation conductors excite identical-direction currents. After the phase-difference modulation, the two radiation conductors inhibit the radiation signals mutually. Thus, cross-polarization is reduced, and the antenna gain is increased.

The second radiation conductors 35 are also a pair of arrayed radiation conductors symmetrical to each other. The second support rod 37 is used to secure the second radiation conductor 35 to the upper surface 311 of the ground plate 31 and makes a gap form between the first radiation conductor 32 and the ground plate 31. The second transmission member 36 is arranged on the lower surface 312 of the ground plate 31. As the second transmission member 36 is parallel to the second axis II-II, the second radiation conductors 35 are also parallel to the second axis II-II. As the first axis I-I is vertical to the second axis II-II, the first radiation conductors 32 are also vertical to the second radiation conductors 35. A second feeder cable 39 has a central conductor 391, an inner insulation layer 392, an outer conductor 393 and an outer insulation layer 394 in sequence from the center. The central conductor 391 connects with the second transmission member 36 at an appropriate position where a signal feeding end is formed. Signals are fed into the second transmission member 36 from the signal feeding end and then evenly transmitted to the second radiation conductors 35. The position of the signal feeding end is also carefully selected to make the two second radiation conductors 35 have a phase difference of 180 degrees. The second antenna system formed of the second radiation conductors 35 can achieve the same effect as the first antenna system formed of the first radiation antenna system 32, and the gain of the second antenna system is also multiplied synergistically.

The PCB of the ground plate 31 has a length of about 80 mm and a width of about 73 mm. The first radiation conductors 32 and the second radiation conductors 35 are rectangles having all the same dimensions, and the rectangles have a length of about 30 mm and a width of about 21 mm. In the first embodiment, the first transmission member 33 is a strip having a length of about 19 mm and a width of about 3 mm; the second transmission member 36 is in form of a microstrip transmission line having a length of about 60 mm and a width of about 1 mm.

In the first embodiment, the transmission members of the first radiation conductors 32 and the second radiation conductors 35 adopt microstrips to directly feed in signals. The two transmission members are respectively arranged at different surfaces of the ground plate 31 which can effectively inhibit the mutual interference of the two transmission members, whereby the energy loss of the networks of the two transmission members is decreased and the signal radiation transmission efficiency is increased, and whereby the design complexity is reduced. The perpendicularity of the first radiation conductors 32 and the second radiation conductors 35 greatly reduces the layout size of the multiple antenna arrays, whereby the present invention is easy-to-assemble for various electronic devices, and whereby the fabrication cost thereof is reduced. Further, the feeding ends are respectively positioned at the appropriate positions of the first transmission member 33 of the first radiation conductors 32 and the second transmission member 36 of the second radiation conductors 36 to enable the symmetric arrayed radiation conductors of the first and second radiation conductors 32 and 35 to have a phase difference of 180 degrees, whereby the cross-polarization is reduced and the gains of the antenna systems are increased.

Figure 5:
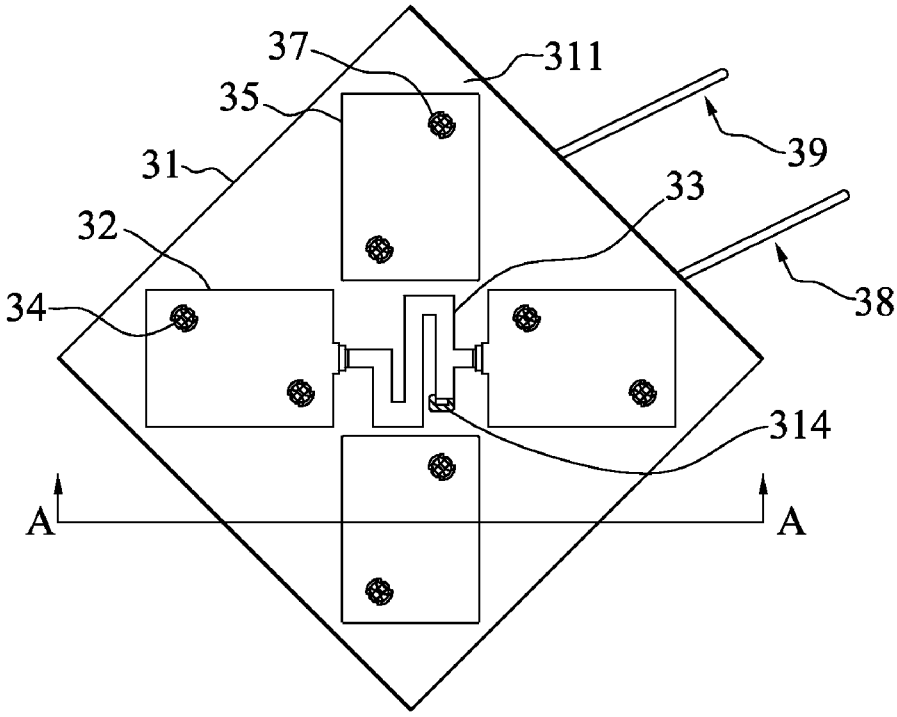
FIG. 5 is a top view of the assembly antenna array shown in FIG. 3.

FIG. 5 shows a top view of an antenna array shown in FIG. 3. As described above, the first feeder cable 38 passes through the via-hole 314 to the upper surface 311 and connects with the first transmission member 33 at the appropriate position. As the feeder cables of the two antenna systems are arranged on the same surface, the soldering becomes more convenient, and the fabrication becomes easier.

Figure 6:
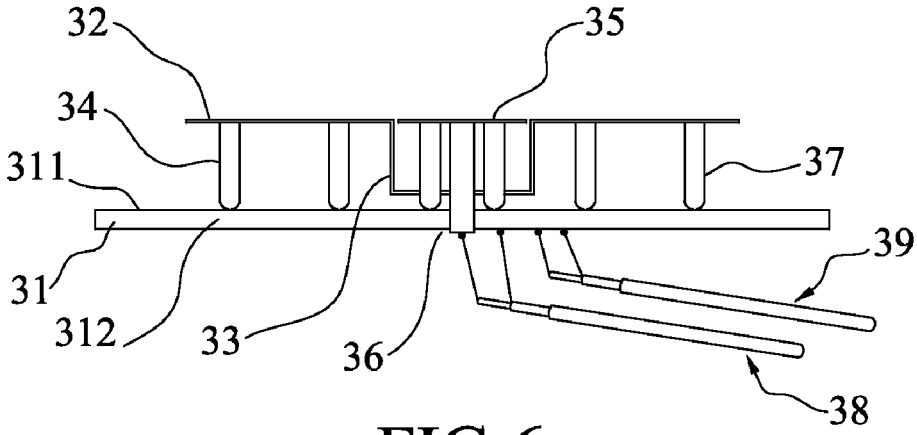
FIG. 6 is a side view from Line A-A in FIG. 3.

FIG. 6 shows a side view from Line A-A in FIG. 3. The first radiation conductors 32 and the second radiation conductors 37 are respectively secured to the upper surface 311 of the ground plate 31 with the first support rods 34 and the second support rods 37. The support rods are made of an insulating material lest the transmission of radiation signals be affected. Besides, gaps are formed between the radiation conductors and the ground plate 31, and the air in the gaps can aid the accumulation of radiation energy.

Figure 7:
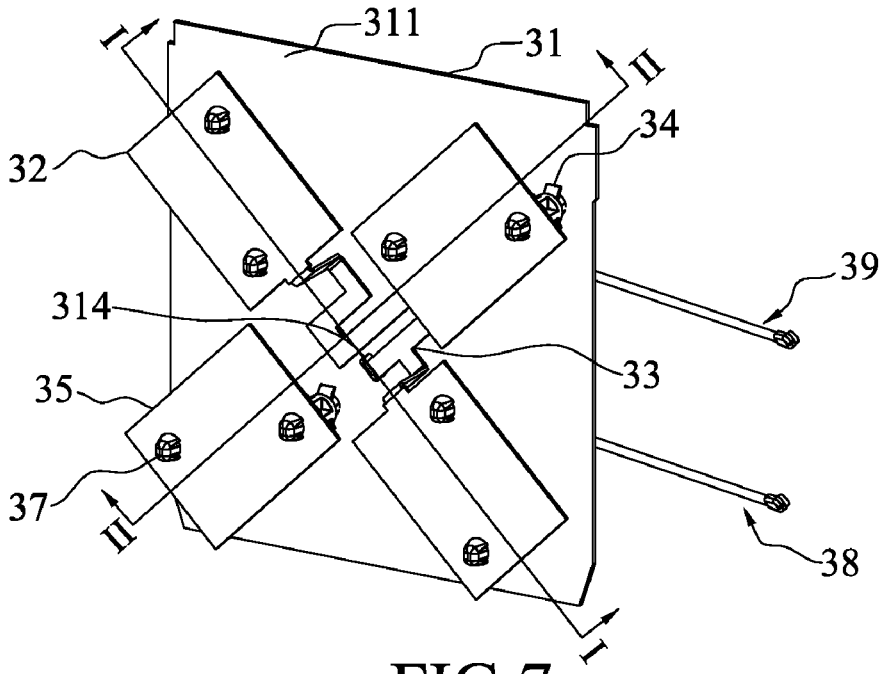
FIG. 7 is a perspective view schematically showing the upper surface an assembly antenna array according to a second embodiment of the present invention.
Figure 8:
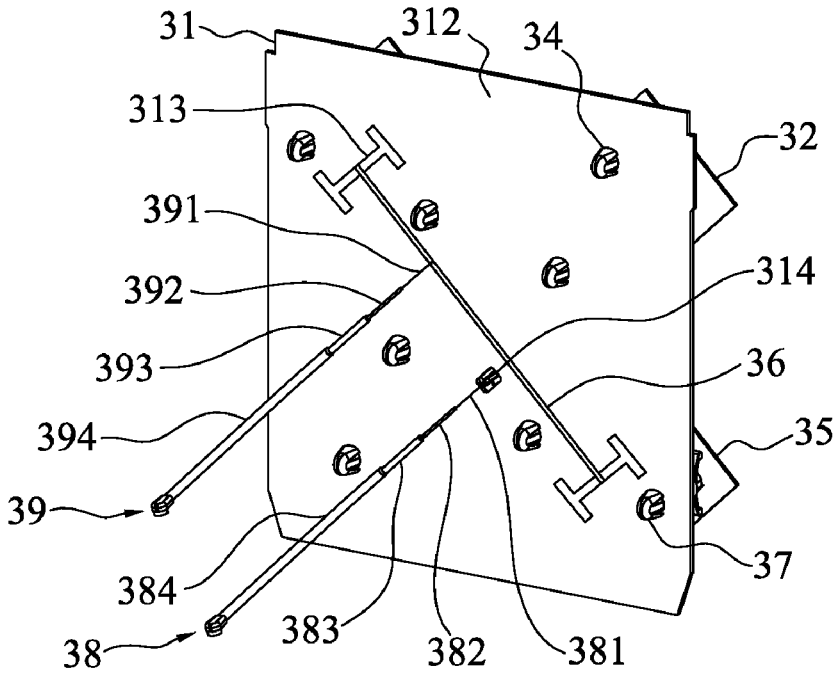
FIG. 8 is a perspective view schematically showing the lower surface the assembly antenna array according to the second embodiment of the present invention.

FIG. 7 and FIG. 8 are perspective views schematically showing the upper surface and the lower surface of an assembly antenna array according to a second embodiment of the present invention. The second embodiment is basically similar to the first embodiment but different from the first embodiment in that the first transmission member 33 of the first radiation conductor 32 is a serpentine structure, and in that the ground plate 31 has at least two slots 313 penetrating the upper surface 311 and the lower surface 312. The slots 313 are located on the region where the upper surface 311 of the ground plate 31 faces the second radiation conductors 35. The second transmission member 36 couples signals to the second radiation conductors 35 via the slots 313. Thereby, the gain of the first antenna system formed of the first radiation conductors 32 and the gain of the second antenna system formed of the second radiation conductors 35 are multiplied synergistically. Further, the cross-polarization is also reduced. Therefore, the second embodiment can achieve the same performance as the first embodiment.

Figure 9:
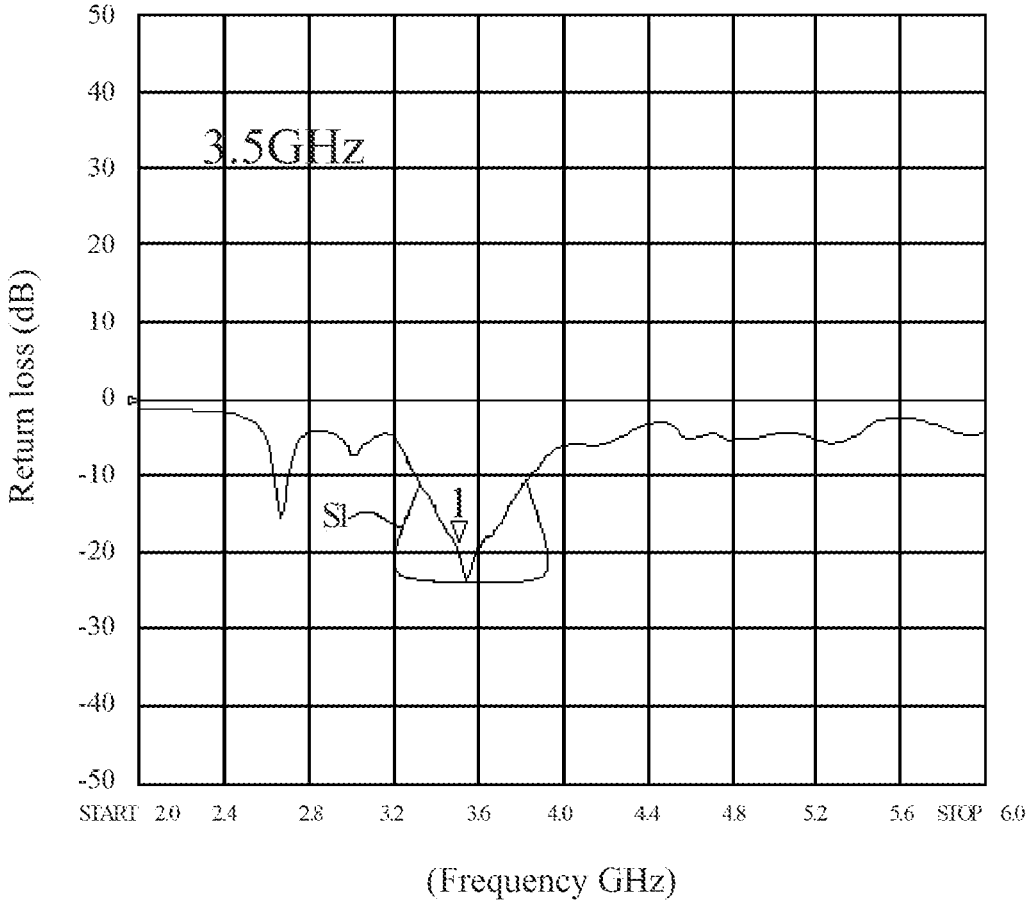
FIG. 9 is a diagram showing the measurement results of the return loss of the first antenna system shown in FIG. 3.

FIG. 9 is a diagram showing the measurement results of the return loss of the first antenna system shown in FIG. 3, wherein the abscissa denotes the frequency and the ordinate denotes the dB value. When a bandwidth S1 of the first antenna system formed of the first radiation conductors 32 is defined by a return loss of over 10 dB, the operation frequency is between 3.3 and 3.8 GHz, which covers the Wimax 3.5 GHz system.

Figure 10:
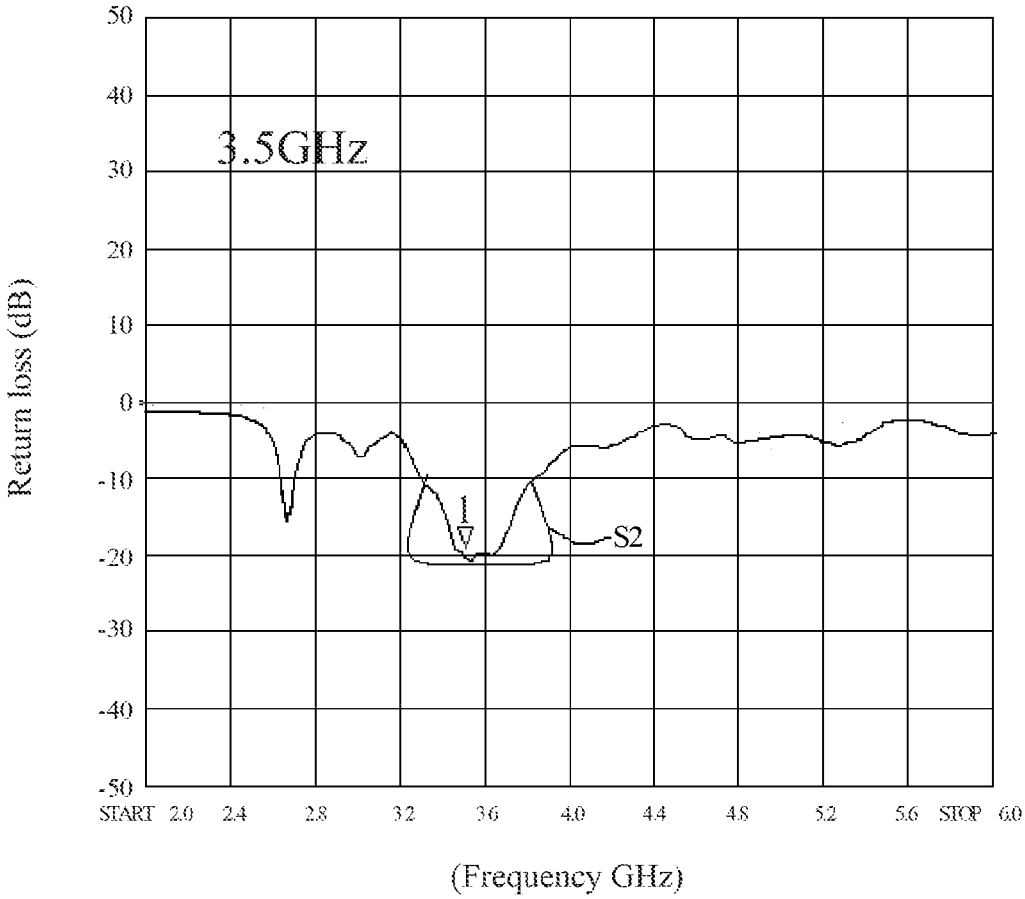
FIG. 10 is a diagram showing the measurement results of the return loss of the second antenna system shown in FIG. 3.

FIG. 10 is a diagram showing the measurement results of the return loss of the second antenna system shown in FIG. 3, wherein the abscissa denotes the frequency and the ordinate denotes the dB value. When a bandwidth S2 of the second antenna system formed of the second radiation conductors 32 is defined by a return loss of over 10 dB, the operation frequency is between 3.3 and 3.8 GHz, which also covers the Wimax 3.5 GHz system. The measurement results show that the first antenna system and the second antenna system can achieve the desired operation frequency bands.

Figure 11:
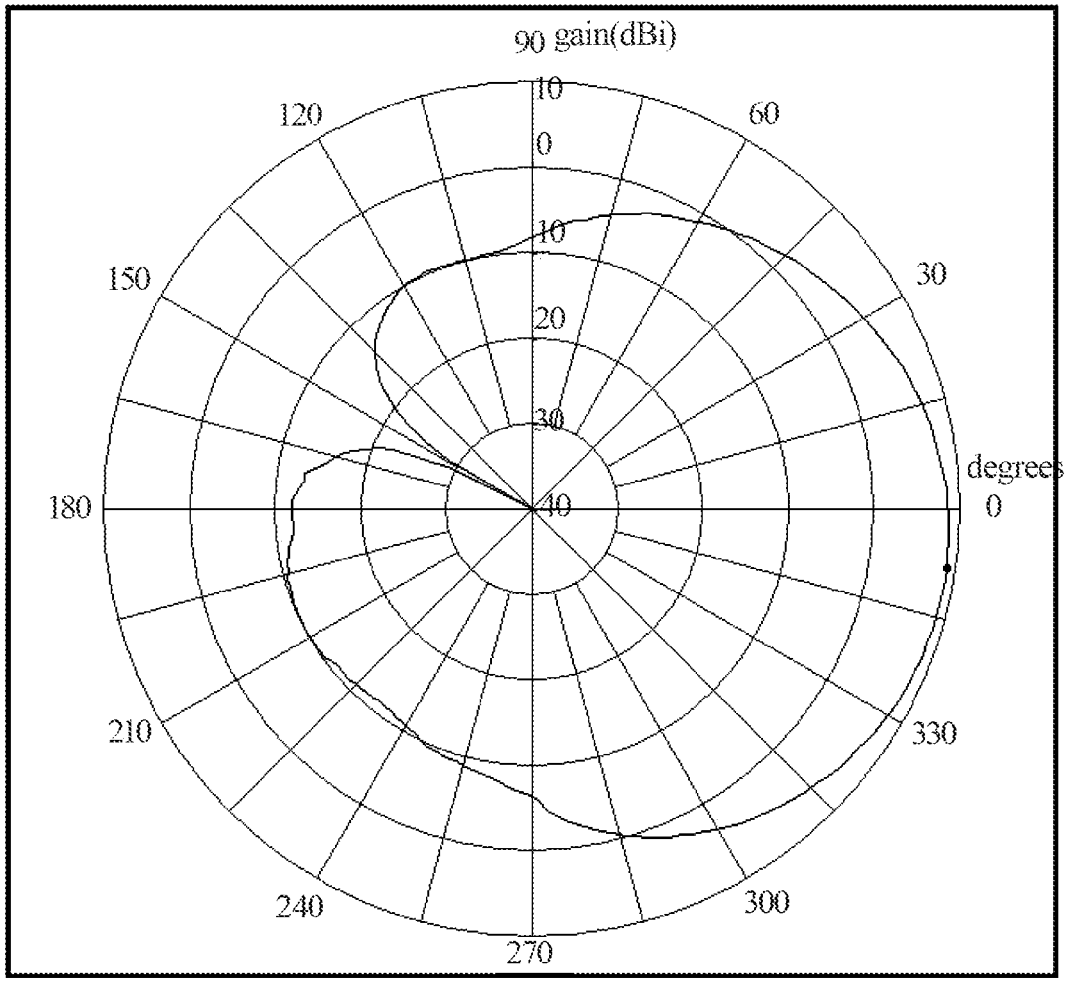
FIG. 11 is a diagram showing the measurement results of the radiation pattern of the first antenna system shown in FIG. 3.

FIG. 11 is a diagram showing the measurement results of the radiation pattern of the first antenna system shown in FIG. 3. When the central frequency of the first antenna system formed of the first radiation conductors 32 is defined to be 3.5 GHz, the radiation pattern thereof has a peak gain of as high as 9.00 dBi, which is much greater than those measured in the prior-art antennae. It proves that the present invention not only can lower the interference on the radiation pattern but also can achieve a high gain.

Figure 12:
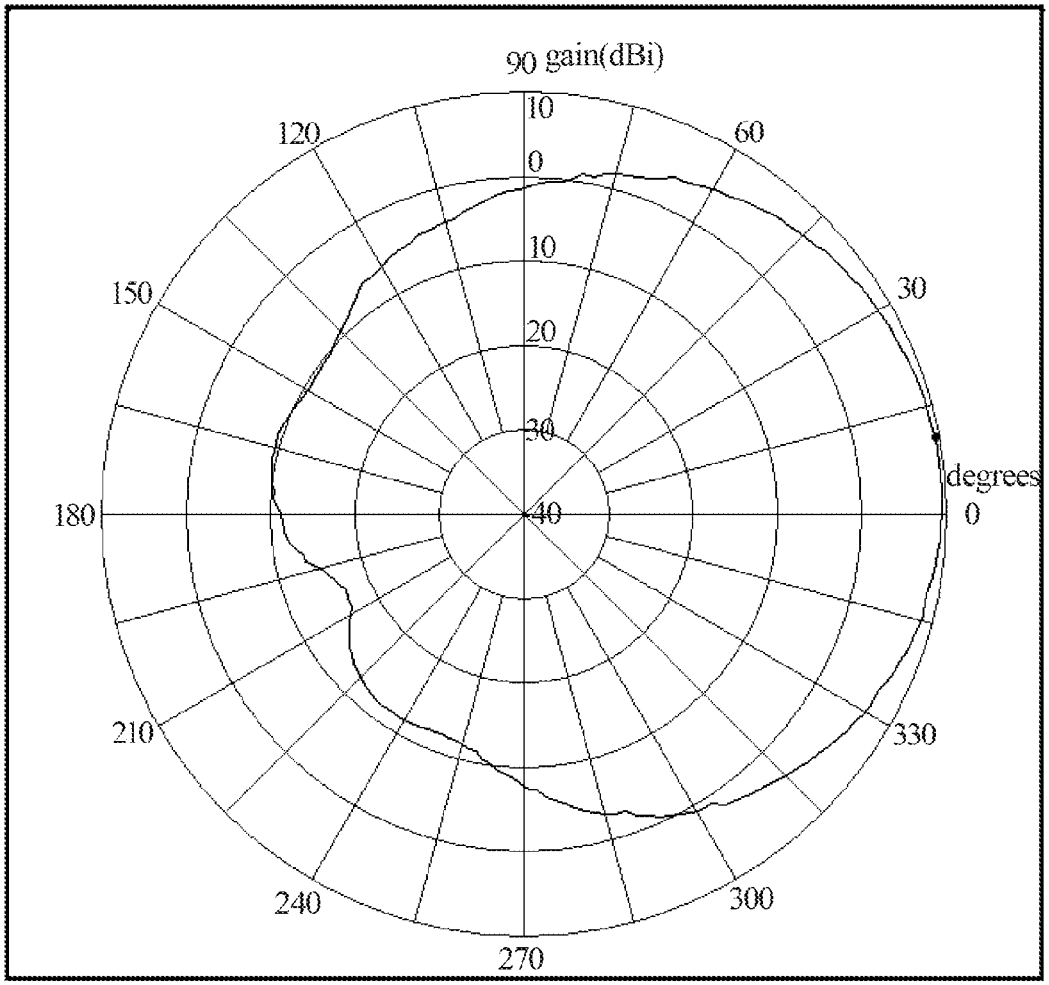
FIG. 12 is a diagram showing the measurement results of the radiation pattern of the second antenna system shown in FIG. 3.

FIG. 12 is a diagram showing the measurement results of the radiation pattern of the second antenna system shown in FIG. 3. When the central frequency of the second antenna system formed of the second radiation conductors 35 is defined to be 3.5 GHz, the radiation pattern thereof has a peak gain of as high as 9.50 dBi, which is much greater than those measured in the prior-art antennae. It proves that the present invention indeed achieves a high gain via arranging the arrayed radiation conductors vertically to each other and arranging the transmission members and the feeding ends on different planes.

Figure 13:
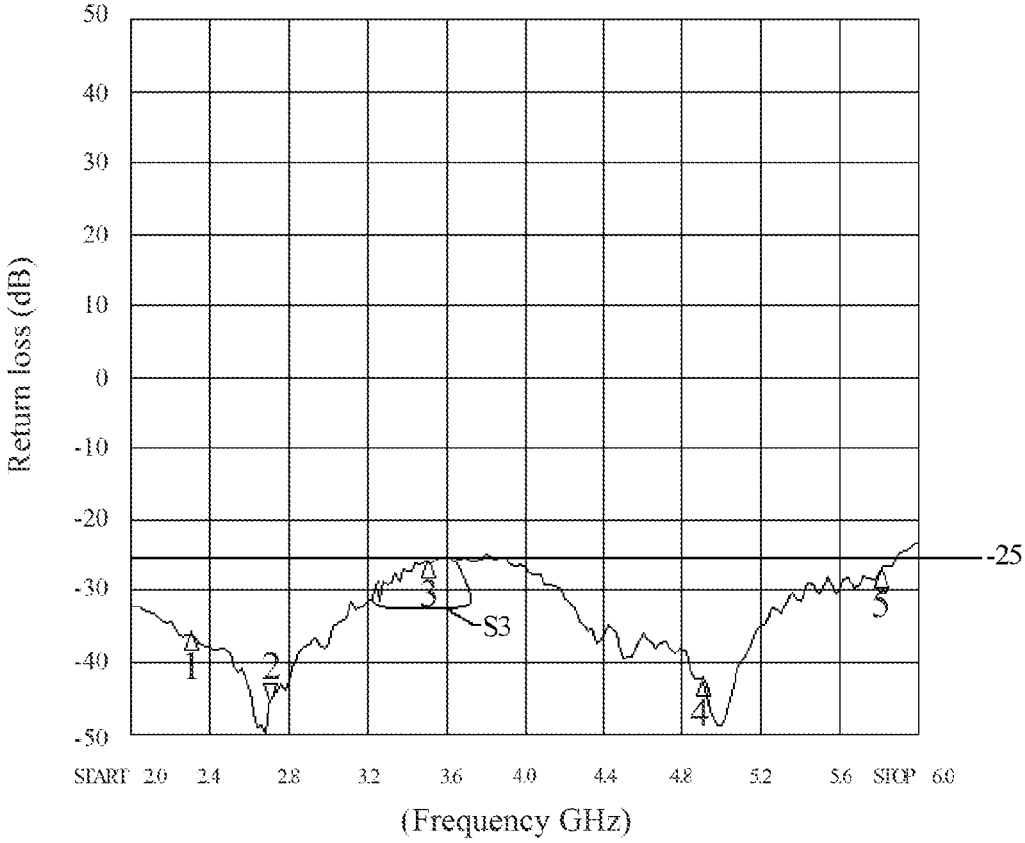
FIG. 13 is a diagram showing the measurement results of the isolation of the assembly antenna array according to the first embodiment of the present invention.

FIG. 13 is a diagram showing the measurement results of the isolation of an assembly antenna array according to the first embodiment of the present invention, wherein the abscissa denotes the frequency and the ordinate denotes the dB value. From the measurement results, it is observed: the isolation S3 is below 25 dB for the Wimax 3.5 GHz system having a frequency band of 3.3-3.8 GHz. It proves that the present invention can indeed inhibit the signal interference between the first radiation conductors and the second radiation conductors and achieve a superior isolation.

Therefore, the present invention indeed possesses utility, novelty and non-obviousness and meets the conditions for a patent. The embodiments described above are only to exemplify the present invention but not to limit the scope of the present invention. Any equivalent modification or variation according to the spirit of the present invention is to be also included within the scope of the present invention.

What is claimed is:

1. An assembly antenna array comprising a ground plate having an upper surface and a lower surface, wherein a first axis and a second axis vertical to said first axis are defined on said ground plate;

a pair of first radiation conductors arranged above said upper surface of said ground plate;

a first transmission member bridging said pair of first radiation conductors and being parallel to said first axis;

at least two first support rods arranged in between said first radiation conductors and said upper surface of said ground plate;

a pair of second radiation conductors arranged above said upper surface of said ground plate;

a second transmission member arranged on said lower surface of said ground plate and being parallel to said second axis; and at least two second support rods arranged in between said second radiation conductors and said upper surface of said ground plate.

2. The assembly antenna array according to claim 1, wherein said first support rods and said second support rods are made of an insulating material.

3. The assembly antenna array according to claim 1, wherein said first radiation conductors are vertical to said second radiation conductors.

4. The assembly antenna array according to claim 1, wherein said first transmission member and said second transmission member are straight-line structures.

5. The assembly antenna array according to claim 1, wherein said first transmission member and said second transmission member are serpentine structures.

6. The assembly antenna array according to claim 1, wherein said second transmission member directly feeds signals to said second radiation conductors.

7. The assembly antenna array according to claim 1, wherein a first feeder cable is connected to an appropriate position of said first transmission member to enable said pair of first radiation conductors to have a phase difference of 180 degrees.

8. The assembly antenna array according to claim 1, wherein a second feeder cable is connected to an appropriate position of said second transmission member to enable said pair of second radiation conductors to have a phase difference of 180 degrees.

9. An assembly antenna array comprising a ground plate having an upper surface, a lower surface and at least two slots penetrating said upper surface and said lower surface, wherein a first axis and a second axis vertical to said first axis are defined on said ground plate;

a pair of first radiation conductors arranged above said upper surface of said ground plate;

a first transmission member bridging said pair of first radiation conductors and being parallel to said first axis;

at least two first support rods arranged in between said first radiation conductors and said upper surface of said ground plate;

a pair of second radiation conductors arranged above said upper surface of said ground plate, wherein said slots are formed on a region of said ground plate where said second radiation conductors face said ground plate;

a second transmission member arranged on said lower surface of said ground plate and being parallel to said second axis; and at least two second support rods arranged in between said second radiation conductors and said upper surface of said ground plate.

10. The assembly antenna array according to claim 9, wherein said first support rods and said second support rods are made of an insulating material.

11. The assembly antenna array according to claim 9, wherein said slots have an H-like shape.

12. The assembly antenna array according to claim 9, wherein said slots have a rectangular shape.

13. The assembly antenna array according to claim 9, wherein said first radiation conductors are vertical to said second radiation conductors.

14. The assembly antenna array according to claim 9, wherein said first transmission member and said second transmission member are straight-line structures.

15. The assembly antenna array according to claim 9, wherein said first transmission member and said second transmission member are serpentine structures.

16. The assembly antenna array according to claim 9, wherein said second transmission member couples signals to said second radiation conductors via said slots.

17. The assembly antenna array according to claim 9, wherein a first feeder cable is connected to an appropriate position of said first transmission member to enable said pair of first radiation conductors to have a phase difference of 180 degrees.

18. The assembly antenna array according to claim 9, wherein a second feeder cable is connected to an appropriate position of said second transmission member to enable said pair of second radiation conductors to have a phase difference of 180 degrees.

* * * * *